United States Patent [19]

Paoluccio

[11] Patent Number: 4,539,916

[45] Date of Patent: Sep. 10, 1985

[54] APPARATUS FOR CLEANING FLUE GASES AND OTHER GASES

[76] Inventor: John A. Paoluccio, 3530 Kiernan Ave., Modesto, Calif. 95356

[21] Appl. No.: 522,002

[22] Filed: Aug. 11, 1983

[51] Int. Cl.[3] ..... F23J 15/00

[52] U.S. Cl. ..... 110/203; 110/224; 110/227; 110/228

[58] Field of Search ..... 110/224, 227, 228, 204, 110/203

[56] References Cited

U.S. PATENT DOCUMENTS

| | | | |
|---|---|---|---|
| 3,333,556 | 8/1967 | Iacobovici | 110/227 |
| 4,167,909 | 9/1979 | Dauvergne | 110/228 X |
| 4,245,570 | 1/1981 | Williams | 110/224 X |
| 4,391,205 | 7/1983 | Morey | 110/224 |

*Primary Examiner*—Edward G. Favors

*Attorney, Agent, or Firm*—Robert S. Smith

[57] ABSTRACT

The invention includes the apparatus and method for cleaning gases such as flue gases. In the apparatus form of the invention a biomass combustion system includes apparatus for holding, at least temporarily, a quantity of biomass fuel, apparatus for directing combustion products from the associated combustion process intermediate a plurality of biomass fuel particles or through a plurality of biomass flue particles, and apparatus for directing flue gas from the apparatus for holding the biomass fuel back to the combustion chamber of the associated biomass combustion system.

4 Claims, 3 Drawing Figures

APPARATUS FOR CLEANING FLUE GASES AND OTHER GASES

BACKGROUND OF THE INVENTION

The invention relates to a novel method and apparatus for enviromental protection and gas cleaning and in one case to flue gas cleaning for reducing particulate emission incident to the combustion of biomass material.

The number of large cogeneration plants burning wood chips and other biomass materials is on the increase. One of the biggest problems these plants face is meeting the air pollution requirements. The present invention could solve this problem.

One application for the invention is to reduce the particulate emissions from the flue gas of biomass cogeneration facilities. Cogeneration plants are able to generate electricity for their own use and sell the excess to an electric power company. Such plants also use the generated steam for processing. Almost any biomass material can be burned for fuel. Examples are wood chips, nut hulls or the like.

The prior art includes the Dauvergne U.S Pat. No. 4,098,200 which shows combustion gases passing over the incoming fuel. Recirculation systems in the prior art include Maitilasso U.S. Pat. No. 3,515,078; Gibeault U.S. Pat. No. 3,815,523; and Paul U.S. Pat. No. 4,089,277.

The present methods of cleaning flue gas include baghouses, precipitation, washing and scrubbing. Both the operating costs and the capital expense related to such methods are extremely high. In addition, they have a relatively short operating life. These high costs and short operating times tend to discourage strict compliance with environmental laws.

An oject of this invention is to provide a simple, inexpensive, effective and practical means of cleaning gases and particularly the dirty flue gas from biomass combustion systems such as steam boiler systems.

An additional object of the invention is to utilize the energy of a hot flue gas to increase the overall efficiency of the system.

SUMMARY OF THE INVENTION

The foregoing objects and other objects and advantages which shall become apparent from the detailed description of the preferred embodiment are attained in an apparatus which includes a flue gas cleaning system for use with an associated biomass combustion process, which includes means for holding at least temporarily a quantity of biomass fuel, means for directing flue gas from the associated combustion process intermediate a pluratlity of biomass fuel particles or through a plurality of biomass flue particles in the means for holding, and means for directing flue gas from the means for holding the biomass fuel back to the combustion chamber of the associated biomass combustion system.

The means for holding a quantity of biomass fuel may be dimensioned and configured for cooperation with the means for directing combusion products and the means for directing flue gas to direct flue gas from the associated combustion chamber to the majority of the biomass fuel held therein. The surface area of the associated biomass fuel in the means for holding from which the associated flue gas exits may be a substantial part of the surface area of the biomass fuel in the means for holding. The apparatus may further include a fan for urging the flue gas through the biomass fuel. In some forms of the invention, the fan may be disposed downstream from the means for holding and an auger shaped member may feed the associated biomass fuel to the associated combustion chamber.

The invention also includes the method of cleaning gases including flue gases such as in a biomass combustion process. The method includes holding at least temporarily a quantity of biomass fuel, directing flue gas from the associated combustion process intermediate a plurality of biomass fuel particles through a plurality of biomass flue particles, and directing the flue gas back to the combustion chamber of the associated biomass combustion system.

In other forms of the invention a gas to be cleaned may be directed through a bed of material one or more times.

BRIEF DESCRIPTION OF THE ACCOMPANYING DRAWING

The invention will be better understood by reference to the accompanying drawing in which.

DESCRIPTION OF THE PREFERRED EMBODIMENT

Figure 1:
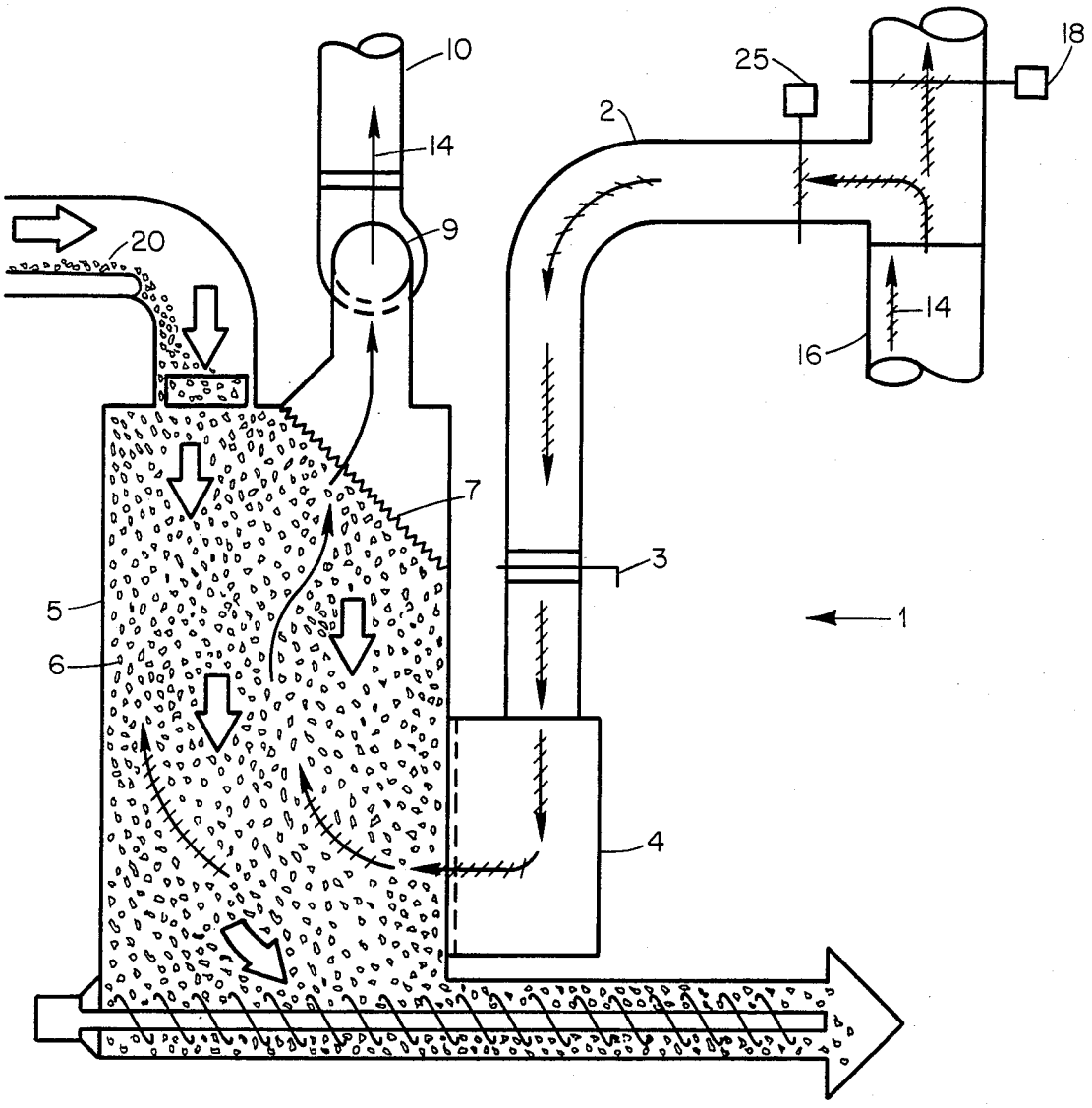
FIG. 1 is a schematic flow diagram of a cleaning apparatus in accordance with the invention showing dirty flue gas entering and leaving the cleaning apparatus.
Figure 2:
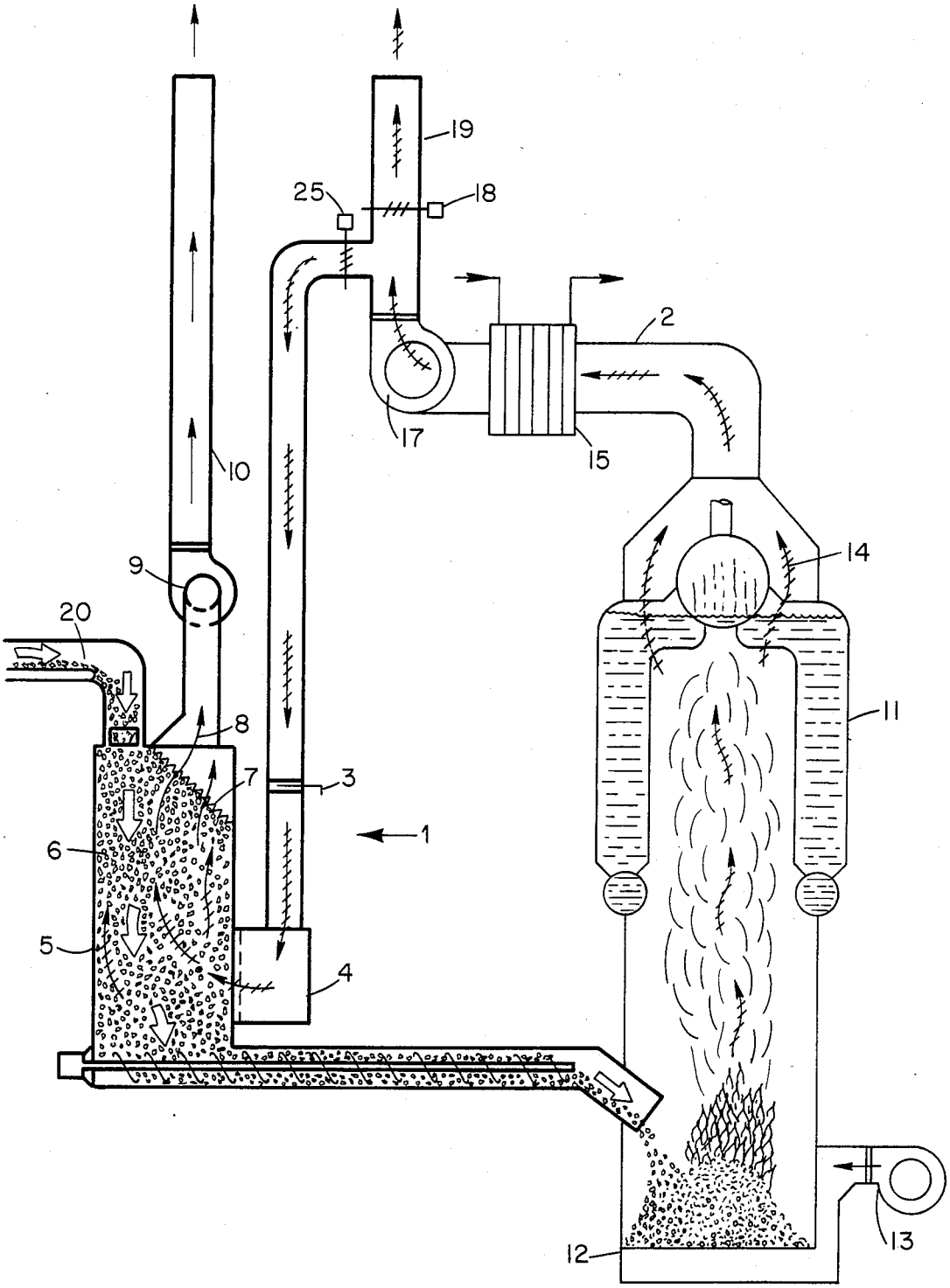
FIG. 2 is a schematic flow diagram of the form of invention similar to that shown in FIG. 1 in a typical application wherein the flue gas from a biomass steam boiler is routed to the cleaning apparatus for cleaning.

Referring now to FIGS. 1 and 2, a biomass flue gas cleaning system 1 includes a dirty flue gas 14 ductwork branch 2 from a main flue 16. Dirty flue gas 14 at the dirty flue gas ductwork branch 2 is routed past a damper 25 (which may be a counter-balanced damper or an electronically or pneumatically controlled device) to another damper 3 to a screened inlet 4 of a biomass fuel feed bin 5. This biomass fuel feed bin 5 is arranged so that the path of the dirty flue gas 14 will travel through biomass fuel 20 which may be, for example, sawdust, wood chips, peach pits, walnut hulls, or any other similar biomass fuel. It will be understood that the flue gas 14 to be cleaned may go in between discrete biomass fuel particles as in the case of nut hulls or wood chips or may pass both around and through the biomass fuel particles, as in the case of more porous materials.

As the hot, dirty flue gas 14 travels through a bed 6 of the biomass fuel 20 and out the very large overall surface of the exit area 7, it is filtered by direct contact. In addition, the flue gas 14 heats the constantly moving biomass fuel 20. The size and shape of the fuel feed bin 5 is important to optimize the flue gas 14 path. The velocity of the flue gas 14 along with the distance traveled determines the pressure drop. This flow rate and the pressure drop affect the horsepower required to drive an exhaust fan 9 or other equivalent fan which moves the flue gases 14 through the biomass fuel bed 6. The incoming biomass fuel 20 is continually moving, thereby exposing different surfaces to the flue gas 14. This results in maximum filtration with near constant air pressure drop.

The flue gas 14 leaves the surface 7 of the biomass fuel 20 in the fuel feed bin 5 cleaned and cooled. The size of the surface 7 from which the gas 14 exits is preferably large in order to prevent feed particles from being picked up by the exiting clean flue gas 14. The clean flue gas 14 is drawn through the exhaust fan 9 and exhausted out a flue duct 10 where this clean, cooled flue gas 14 poses the least possible threat of damage to the enviroment or its inhabitants.

As best seen in FIG. 2, dried and heated biomass fuel 20 enters a combustion cell 12 of a steam boiler 11. The ash and products of combustion mix with incoming combustion air by a blower 13. Additional hot, dirty flue gas 14 leaves the steam boiler 11 at approximately 550 degrees Fahrenheit to 650 degrees Fahrenheit and passes through an economizer or heat exchanger 15. Many types are currently available where useful energy is extracted for heating water for remote use. The economizer or heat exchanger 15 includes controls to avoid cooling the flue gas 14 below 250 degrees Fahrenheit to avoid condensation. The flue gas 14 leaving the economizer or heat exchanger 15 has a temperature of approximately 250 degrees Fahrenheit to 350 degrees Fahrenheit. A fan or blower 17 urges the flue gas 14 through the economizer or heat exchanger 15 and the flue duct 19. The majority of the flue gas 14 is directed to the biomass fuel gas cleaning system 1. That part of the flue gas 14 not diverted to the biomass fuel gas cleaning system 1 is directed through a counter-balanced damper 18 which always provides for a constant flue gas flow. The counter-balanced damper 18 works in conjunction with the damper 15 to control the combustion products. If the biomass fuel 20 is denser than normal, for example, the flue gas 14 flowing through the counter-balanced damper 18 will be reduced. Accordingly, the counter-balanced damper 18 opens wider and more flue gas 14 will exhaust through the flue duct 19 in order to provide for an overall constant flow of the flue gas 14.

The particulates in the flue gas 14 are filtered through the constantly moving bed 6 of the biomass fuel 20 such as wood chips. The tremendous surface area 7 of the biomass fuel 6 easily captures submicron particles. It wil be understood that the surface area of the bed 6 through which the gas 14 exits as well as the surface area of the particles in the bed 6 affect the thoroughness of the cleaning action.

Figure 3:
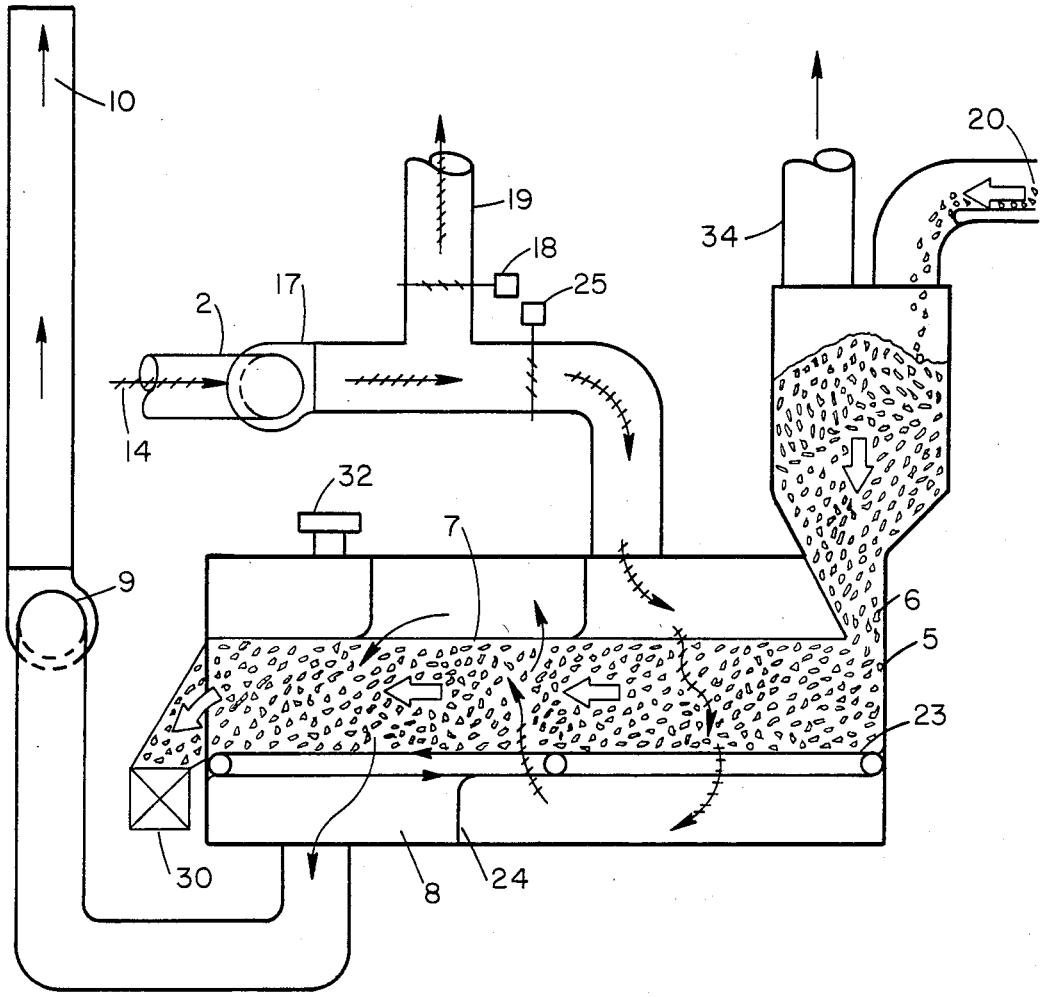
FIG. 3 is a schematic flow diagram of another form of the invention where a dirty air or gas stream is cleaned in a multiple pass, continuous flow process.

The invention also has application to cleaning other gases. For example, the dirty gas 14 can be run through a continuous flow high surface area mass. As best shown in FIG. 3, any flue gas or gas 14 in which dust or other matter is suspended may be cleaned by circulation through the bed 6 of the biomass fuel or material 20. Preferably this is a multipass system in which the dirty gas 14 passes through the ductwork branch 2 to the fan or blower 17. Although a multipass system is preferred, it will be understood that the invention also contemplates single pass systems. A portion of the gas 14 is directed through a counter-balanced damper 18 and up the flue duct 19. The rest of the dirty gas 14 passes through the damper 25 and through the surface 7 of the bed 6 of the material 20. The gas 14 may, for example, have grain carried therein and the bed 6 may be a bed 6 of grain. The material 20, such as grain, is fed to the fuel feed bin 5, which has an exhaust port 34 which may have a blower (not shown) installed therein.

The bed 6 of the material 20 is carried on a conveyor belt 23, such as grain, from the fuel feed bin 5 to a consumption point 30. Cooling air may be added at an inlet 32. The exhaust fan 9 has the inlet thereof connected to a region 8 underneath the conveyor belt 23. An optional rubber partition 24 further limits flow of gas from the fan or blower 17 under the conveyor belt 23 and out through the exhaust fan 9. Alternatively, the rubber partition 24 may be eliminated and the multipass flow pattern still achieved by proper selection of the respective fan or blowers 9 and 17. Desirably the dirty gas 14 pases down and completely through the bed 6, back up through the bed 6, and then back down again through the bed 6. It will be seen that this multipass arrangement causes still better removal of particulate emissions.

The advantages of the present invention are extensive, including (a) excellent cleaning of the flue gas; (b) very low captial expense; (c) very low operating costs; (d) drying and heating biomass fuel prior to its entry into the boiler combustion cell facilitates more uniform combustion with better control; (e) the apparatus has little to wear out; (f) the boiler efficiency is increased by 10 to 20 percent and, thus, fuel bills are reduced by 10 to 20 percent; (g) the collected emissions are burned with the biomass fuel and most turn to ashes; (h) all condensation of water and corrosive acids is absorbed by the biomass fuel such as wood chips, thereby eliminating corrosion to the metal structure; (i) the method and apparatus may be used with most existing biomass fuel burning systems; (j) this method and apparatus wil encourage industry to reduce particle emissions since a cost effective solution is possible; and (k) a highly benefical system attaining results having multiple benefits which will encourage tougher enforcement of air pollution emission standards resulting in a safer enviroment.

The invention has been described with reference to its illustrated preferred embodiment. Persons skilled in the art of constructing environmental protection apparatus may, upon exposure to the teachings herein, conceive variations in the mechanical development of the components therein. Such variations are deemed to be encompassed by the disclosure, the invention being delimited only by the appended claims.

Having thus described my invention, I claim:

1. A flue gas cleaning system for use with an associated biomass combustion system, which comprises:

means for holding, at least temporarily, a quantity of biomass fuel, said means for holding comprising a porous conveyor belt moving through said means for holding;

means for directing flue gas from the associated combustion system intermediate a plurality of biomass fuel particles or through a plurality of biomass fuel particles in said means for holding, said means for holding a quantity of biomass fuel being dimensioned and configured for cooperation with said means for directing flue gas; and said means for directing including means bypassing said means for holding.

2. The apparatus as described in claim 1, wherein: the surface area of the associated biomass fuel in said means for holding from which the associated flue gas exits is a substantial part of the surface area of said fuel in said means for holding.

3. The apparatus as described in claim 2, further including: a fan for urging said flue gas through the biomass fuel.

4. The apparatus as described in claim 3, wherein: said fan is disposed downstream from said means for holding.

* * * * *